US006211866B1

(12) United States Patent
Okutani

(10) Patent No.: US 6,211,866 B1
(45) Date of Patent: Apr. 3, 2001

(54) GRAYSCALE VOLTAGE GENERATING CIRCUIT

(75) Inventor: Shigeki Okutani, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/107,286

(22) Filed: Jun. 30, 1998

(30) Foreign Application Priority Data

Jun. 30, 1997 (JP) ..... 9-189248

(51) Int. Cl.[7] ..... G09G 5/00

(52) U.S. Cl. ..... 345/209; 345/210; 345/94; 345/95; 345/96

(58) Field of Search ..... 345/87, 95, 96, 345/204, 209, 211, 212, 147, 99

(56) References Cited

U.S. PATENT DOCUMENTS 4,326,784 * 4/1982 Ichiyanagi ..... 396/290
5,229,761 * 7/1993 Fuse ..... 345/99
5,283,477 * 2/1994 Shibata ..... 307/306
5,841,412 * 11/1998 Ebihara ..... 345/58

FOREIGN PATENT DOCUMENTS 6-348235 12/1994 (JP) .

* cited by examiner

*Primary Examiner*—Dennis-Doon Chow
*Assistant Examiner*—Amr Awad
(74) *Attorney, Agent, or Firm*—Sughrue, Mion, Zinn, Macpeak & Seas, PLLC

(57) ABSTRACT

A halftone-level reference voltage is generated by a resistance-type potential divider circuit from a potential between a high-potential grayscale voltage and a low-potential grayscale voltage on the side of positive polarity, and a halftone-level grayscale voltage, which is capable of being varied, is generated from the halftone reference voltage by an amplifier, which uses a variable resistor as a feedback resistor. All grayscale voltages on the side of positive polarity are inverted with respect to the ground potential of a liquid crystal panel and amplified by the same ratio by amplifiers. As a result, grayscale voltages on the side of negative polarity are produced as outputs. Potentials to which feed-through correction values have been added are set individually as liquid crystal ground potentials on low- and high-potential sides. With regard to halftone levels, feed-through correction values are adjusted automatically in conformity with amount of change in grayscale voltage.

6 Claims, 5 Drawing Sheets

GRAYSCALE VOLTAGE GENERATING CIRCUIT

FIELD OF THE INVENTION

This invention relates to a liquid crystal display device and, more particularly, to a grayscale voltage generating circuit used in circuitry for driving a liquid crystal display device which presents a multi-level grayscale (graduation) display.

BACKGROUND OF THE INVENTION

A grayscale voltage generating circuit for a liquid crystal display device of this type has been disclosed in the specification of Japanese Patent Kokai Publication JP-A-6-348235, by way of example. Specifically, the specification proposes a grayscale voltage generating circuit comprising a plurality of fixed resistors serially connected between a high-potential reference voltage and a low-potential reference voltage, and voltage varying means capable of varying the voltages at the nodes between the fixed resistors between the high-potential reference voltage and the low-potential reference voltage, with the voltages at the nodes between the fixed resistors being used as grayscale signals.

FIG. 5 illustrates part of this prior-art grayscale voltage generating circuit. Though there are eight outputs of positive polarity and eight outputs of negative polarity according to the description given in the above-mentioned Japanese Patent Kokai Publication JP-A-6-348235 (see FIG. 1 of the specification), here the grayscale voltage generating circuit will be described as a circuit having three outputs of each of the positive and negative polarities.

As shown in FIG. 5, the prior-art grayscale voltage generating circuit includes fixed resistors R1 to R4 and a variable resistor VR3 serially connected between a reference voltage VH and a reference voltage VL, variable resistors VR1, VR2 serially connected between the reference voltage VH and reference voltage VL, an amplifier circuit (a voltage-follower operational amplifier) A1 connected between the node of the fixed resistors R1, R2 and the variable resistor VR1, and an amplifier circuit A2 connected between the node of the fixed resistors R3, R4 and the variable resistor VR2.

The reference voltages VH and VL in this grayscale voltage generating circuit are output as is as a high-potential grayscale voltage V0H on the side of positive polarity and a high-potential grayscale voltage V0L on the side of negative polarity, respectively. A halftone grayscale voltage V1H and a low-potential grayscale voltage V2H on the side of positive polarity as well as a low-potential grayscale voltage V2L and a halftone grayscale voltage V1L on the side of negative polarity can be adjusted by adjusting the resistance values of the variable resistors VR1, VR2 connected to the input side of the amplifier circuits A1, A2, respectively, and the resistance value of the variable resistor VR3 located between the grayscale voltage V2H and grayscale voltage V2L.

The above-described grayscale voltage generating circuit makes it possible to improve upon a change in grayscale characteristic brought about by a change in viewing angle, namely the angle from which a liquid crystal display monitor is viewed. This change in grayscale characteristic due to a change in viewing angle is one characteristic of a liquid crystal display monitor primarily of the twisted nematic type.

Owing to the characteristics of the liquid crystal in a liquid crystal monitor, it is required that identical positive and negative voltages be applied in AC drive. Furthermore, it is necessary to correct for a shift (referred to as a "feed-through characteristic") in ground potential of the liquid crystal caused by a difference in the voltages applied to the liquid crystal (e.g., as when 1 V is applied and when 5 V is applied). This correction is referred to as a "feed-through correction."

In the above-described grayscale voltage generating circuit, feed-through correction values are decided by the potential dividing ratio of the serially connected fixed resistors R2, R3 and variable resistor VR3 and the adjustment of the resistance values of the variable resistors VR1, VR2. Consequently, even if the variable resistors VR1, VR2 are varied to obtain the optimum grayscale characteristic and optimize the feed-through correction values of the grayscale voltages V1H, V1L in order to improve upon the grayscale characteristic based upon the viewing angle, the feed-through correction values of the low-potential grayscale voltages V2H, V2L are decided solely by the potential dividing ratio determined by the fixed resistors R2, R3 and variable resistor VR3 between the halftone-level grayscale voltages V1H, V1L. In other words, adjusting the variable resistor VR3 merely changes the potential difference between the low-potential grayscale voltages V2H and V2L. This means that these feed-through correction values cannot be adjusted individually for each of the positive and negative polarities.

As a consequence of the foregoing, the feed-through correction values of the grayscale voltages V2H, V2L differ from the appropriate values.

SUMMARY OF THE DISCLOSURE

In the course of the investigations toward the present invention the following problems have been encountered in the prior art.

First, the variable resistances which decide the grayscale voltages (grayscale characteristic) on the side of positive and negative polarity are required to be adjusted by identical ratios at adjusting points provided on both the positive- and negative-polarity sides, and this necessitates the use of measuring equipment such as a voltmeter. Consequently, it is difficult for the user of the liquid crystal monitor to adjust the grayscale characteristic without using measuring equipment. The reason for this is that in order to operate a liquid crystal panel, it is necessary to drive the liquid crystal by an AC voltage and apply the grayscale voltages on the sides of positive and negative polarity at identical ratios with respect to the ground potential of the applied voltage.

The second problem is that when a grayscale voltage is varied, the feed-through correction must be performed again. For example, if grayscale voltage is varied in the grayscale voltage generating device shown in FIG. 5, the ideal feed-through correction values to be applied to the liquid crystal panel will no longer be obtained. The reason for this is as follows: In the grayscale voltage generating circuit shown in FIG. 5, the high-potential grayscale voltages V0H, V0L serve as the references and the high-potential feed-through correction values need not be varied to accomplish the feed-through correction. The feed-through correction of the halftone levels can be performed by adjusting the variable resistor VR1 in such a manner that the grayscale voltage V1H will agree with a grayscale voltage to which a feed-through correction value on the positive polarity side has been added and adjusting the variable resistor VR2 in such a manner that the grayscale voltage V1L will agree with a grayscale voltage to which a feed-through correction value on the negative polarity side has been added. However, since the low-potential feed-through correction is decided by the potential dividing ratio of the potential dividing resistors R2, R3, VR3 located between the grayscale voltages V1H and V1L, the correction is influenced by a change in the halftone-level grayscale voltages V1H, V1L and low-potential feed-through correction values that should be constant levels are no longer obtained.

Accordingly, the present invention seeks to solve the aforementioned problems and, it is an object thereof to provide a grayscale voltage generating circuit for a liquid crystal display device in which, by adjusting a variable resistor at only one location without use of measuring equipment, halftone-level grayscale voltages on the positive and negative polarity sides can be varied simultaneously over identical voltage ranges without affecting high- and low-potential grayscale voltages.

It is another object to provide a grayscale generating circuit in which ideal halftone-level feed-through correction values to be applied to the liquid crystal panel can be varied simultaneously on the sides of positive and negative polarity without affecting the high- and low-potential grayscale voltages and the feed-through correction values.

Further objects of the present invention will become apparent in the entire disclosure.

According to an aspect of the present invention, the foregoing object is attained by providing a grayscale voltage generating circuit comprising means for generating a halftone-level reference voltage by resistance-type potential division of a potential between positive-polarity high- and low-potential grayscale voltages that are outputs obtained by amplifying voltages produced by potential division of a reference power supply voltage, first amplifying means for generating a variable halftone-level grayscale voltage from the halftone-level reference voltage using a variable resistor as a feedback resistor, and second amplifying means for inverting all positive-polarity grayscale voltages with respect to a liquid crystal ground potential, which has been obtained by potential division and amplification of the reference power supply voltage, amplifying the inverted grayscale voltages by the same ratio and outputting the amplified voltages as negative-polarity grayscale voltages.

In the grayscale voltage generating circuit according to the present invention, a halftone-level reference voltage (VA in FIG. 1) is generated by a resistance-type potential divider circuit from a potential between a high-potential grayscale voltage and a low-potential grayscale voltage on the side of positive polarity, and a halftone-level grayscale voltage (V1H in FIG. 1), which is capable of being varied to be an intermediary, is generated from the halftone reference voltage by an amplifier (A3 in FIG. 1), which uses a variable resistor (VR1 in FIG. 1) as a feedback resistor. All grayscale voltages on the side of positive polarity are inverted with respect to the ground potential (VB in FIG. 1) of a liquid crystal panel and amplified by the same ratio by amplifiers (A5 to A7 in FIG. 1).

Further, on both the sides of positive and negative polarity, high- and low-potential feed-through correction values are rendered constant, and a halftone-level feed-through correction value is varied automatically in dependence upon a change in the halftone-level grayscale voltage on the side of positive polarity, whereby there are obtained ideal feed-through correction values to be applied to the liquid crystal cell.

In the present invention, a halftone-level grayscale voltage (V1L in FIG. 1) on the side of negative polarity also is capable of being varied by the amplifier that inverts and amplifies the positive-polarity halftone-level grayscale voltage made variable by the variable resistor (VR1 in FIG. 1). Thus, by varying a resistor at a single location, positive- and negative-polarity grayscale voltages can be adjusted at the same time.

Further, by continuously varying the halftone-level ground potential of the liquid crystal panel, the variable halftone-level grayscale voltage can always be made one which is the result of adding on a suitable feed-through correction value.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

Modes for practicing the present invention will be described below.

Figure 1:
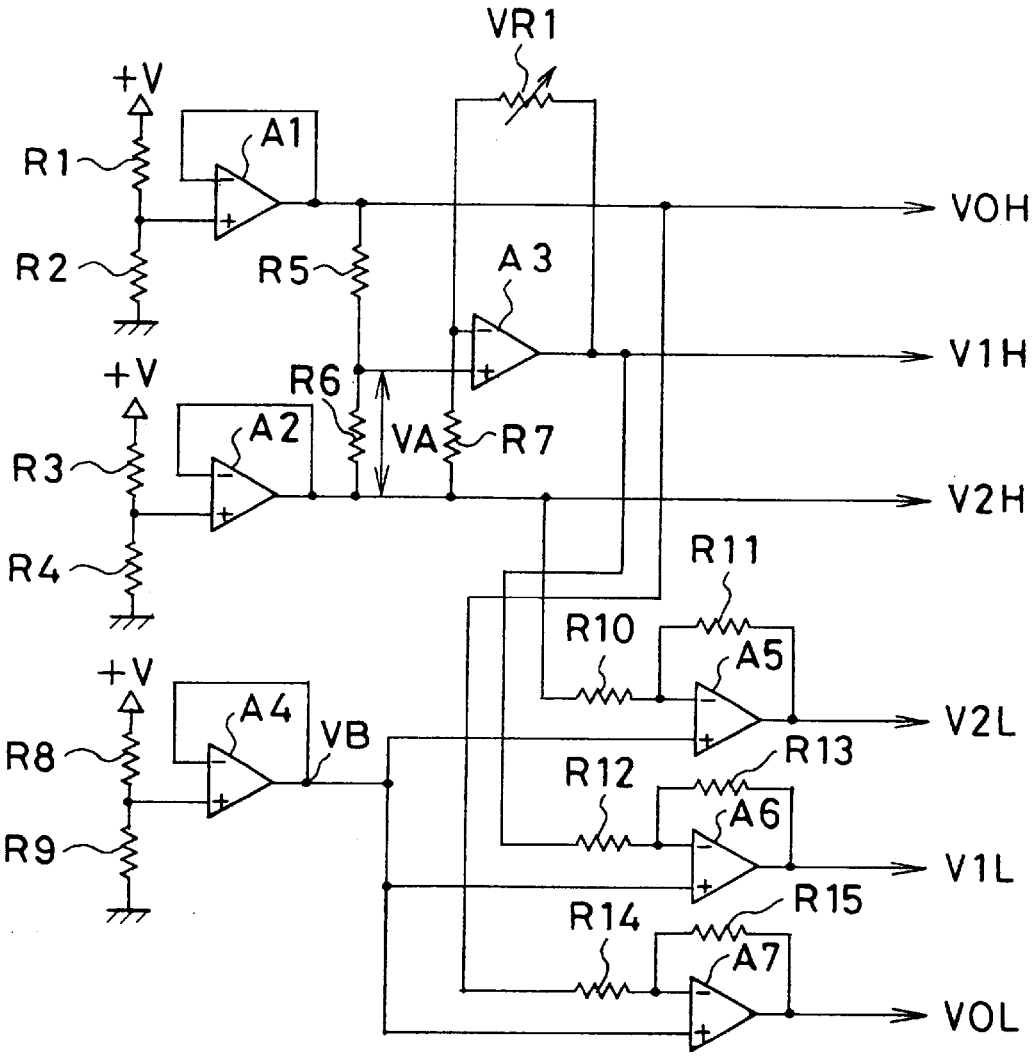
FIG. 1 is a circuit diagram illustrating the circuitry of a first embodiment of a grayscale voltage generating circuit according to the present invention.

FIG. 1 is a circuit diagram illustrating the circuitry of a first embodiment of a grayscale voltage generating circuit according to the present invention.

The circuit components for generating grayscale voltages on the side of positive polarity will be described first. As shown in FIG. 1, a voltage produced from a reference voltage +V by a potential dividing circuit composed of resistors R1 and R2 is buffered by an amplifier A1, which outputs a grayscale voltage V0H on the high-potential side. A voltage produced from the reference voltage +V by a potential dividing circuit composed of resistors R3 and R4 is buffered by an amplifier A2, which outputs a grayscale voltage V2H on the low-potential side. The potential between the grayscale voltages produced by the amplifiers A1 and A2 is divided by a potential dividing circuit composed of resistors R5 and R6, whereby a voltage VA is obtained. A halftone-level grayscale voltage V1H, whose voltage value is capable of being adjusted, is produced from the voltage VA by an amplifier A3 using a variable resistor VR1 as a feedback resistor.

The circuit components for generating grayscale voltages on the side of negative polarity will be described next. A voltage produced from the reference voltage +V by a potential dividing circuit composed of resistors R8 and R9 is buffered by an amplifier A4, which produces a voltage VB serving as the ground level of a liquid crystal panel. The ground-level voltage VB is used as the bias voltage of amplifiers A5, A6 and A7, which invert and amplify the positive-polarity grayscale voltages V0H, V1H and V2H to negative-polarity grayscale voltages V0L, V1L and V2L, respectively.

Figure 2:
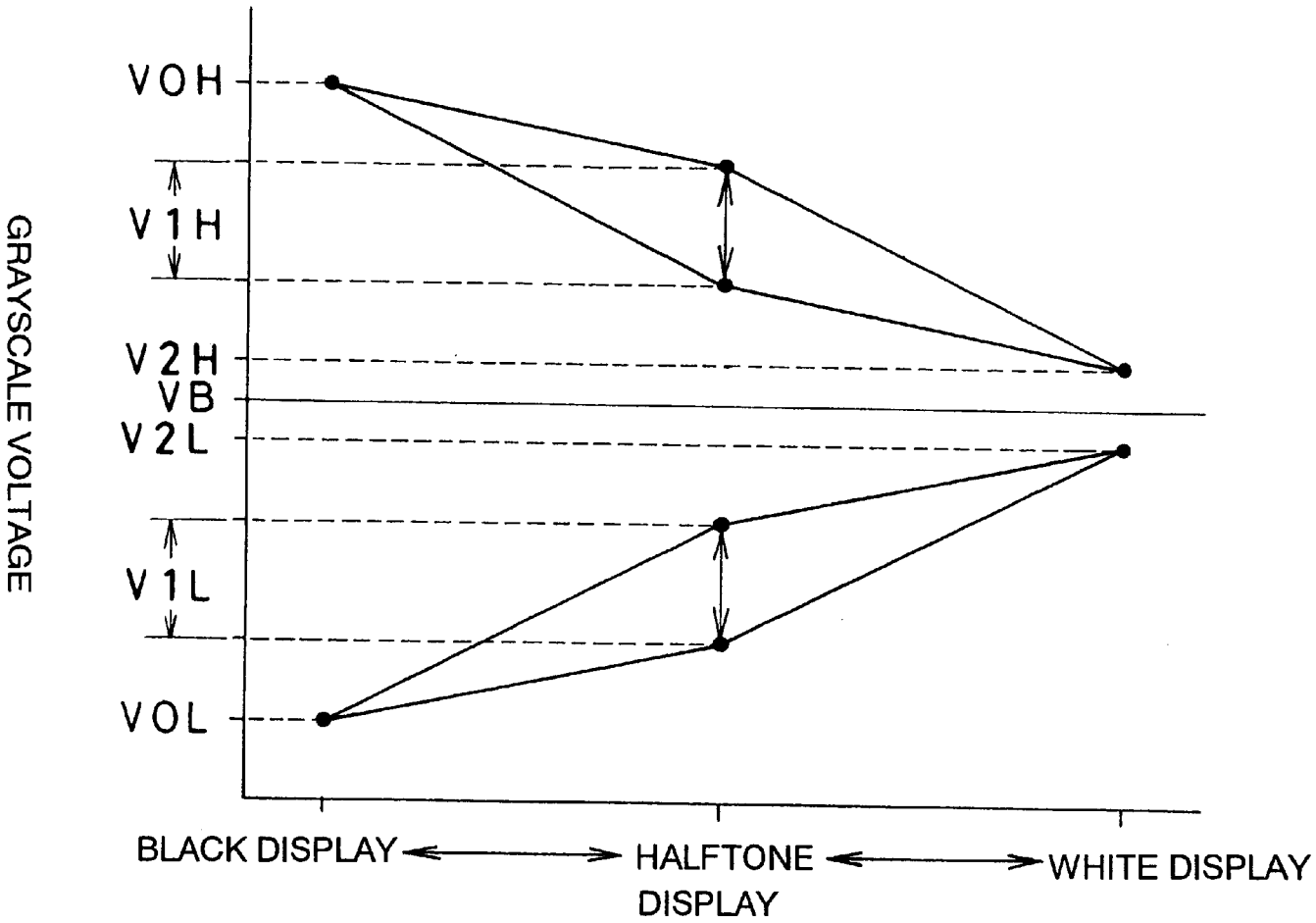
FIG. 2 is a diagram useful in describing adjustment of voltage in the first embodiment of the grayscale voltage generating circuit according to the present invention.

FIG. 2 is a diagram useful in describing adjustment of voltage according to the first embodiment of the invention. Reference will be had to FIG. 2 to describe the operation of the grayscale voltage generating circuit shown in FIG. 1.

The high-potential grayscale voltage V0H on the side of positive polarity is rendered constant by the amplifier A1 functioning as a buffer. Similarly, the low-potential grayscale voltage V2H on the side of positive polarity is rendered constant by the amplifier A2 functioning as a buffer.

The halftone-level grayscale voltage V1H, for which the reference voltage is the voltage VA obtained potential-dividing the grayscale voltages V0H and V2H, is capable of being varied from VA+V2H to VA×(1+VR1/R7)+V2H by using the variable resistor VR1 serving as the feedback resistor.

Using the voltage VB, which is the ground potential of the liquid crystal panel produced by the amplifier A4, as a bias voltage, the amplifiers AS, A6 and A7 invert and amplify the positive-polarity grayscale voltages V0H, V1H, V2H, respectively, by an amplification factor of one. As a result, the grayscale voltages V0L, V1L and V2L output by the respective amplifiers A7, A6 and A5 have identical potentials as the grayscale voltages V0H, V1H and V2H, respectively, with respect to the voltage VB of the ground potential of the liquid crystal panel.

EXAMPLES

Preferred embodiments of the present invention will now be described in greater detail with reference to the drawings.

The positive-polarity side of the circuitry according to the first embodiment will be described first. As shown in FIG. 1 illustrating the first embodiment, fixed resistors R1, R2 are serially connected between the reference power supply voltage +V and ground, thereby potential-dividing the reference voltage. The resulting voltage is input to the + (non-inverting) input terminal of the amplifier A1, the − (inverting) input terminal and output terminal of which are connected together. As a result, the amplifier A1 outputs the high-potential grayscale voltage V0H. Fixed resistors R3, R4 are serially connected between the reference power supply voltage +V and ground, thereby potential-dividing the reference voltage. The resulting voltage is input to the + input terminal of the amplifier A2, the − input terminal and output terminal of which are connected together so that amplifier A2 outputs the low-potential grayscale voltage V2H. Fixed resistors R5, R6 are serially connected between the high-potential grayscale voltage V0H and the low-potential grayscale voltage V2H, thereby producing the voltage VA by potential division. The voltage VA is input to the + input terminal of the amplifier A3, which amplifies this voltage but does not invert it. The − input terminal of amplifier A3 is connected to the grayscale voltage V2H via resistor R7 as well as to the output terminal via the variable feedback resistor VR1. As a result, the amplifier A3 outputs the variable halftone-level grayscale voltage V1H.

Next, with regard to the circuitry that produces the grayscale voltages on the side of negative polarity, fixed resistors R8, R9 are serially connected between the reference power supply voltage +V and ground, thereby potential-dividing the reference voltage. The resulting voltage is input to the + input terminal of the amplifier A4, the − input terminal and output terminal of which are connected together. As a result, the amplifier A4 produces the voltage VB serving as the ground potential of the liquid crystal panel.

The voltage VB serving as the ground potential of the liquid crystal panel is input to the + input terminal of the amplifier AS, which is constructed as an inverting amplifier, the low-potential grayscale voltage V2H on the side of positive polarity is input to the − input terminal via a fixed resistor R10, and the − input terminal of amplifier A5 is connected to the output terminal via a feedback resistor R11, whereby the amplifier A5 outputs the low-potential grayscale voltage V2L.

The voltage VB serving as the ground potential of the liquid crystal panel is input to the + input terminal of the amplifier A6, which is constructed as an inverting amplifier, the halftone-level grayscale voltage V1H on the side of positive polarity is input to the − input terminal via a fixed resistor R12, and the − input terminal of amplifier A6 is connected to the output terminal via a feedback resistor R13, whereby the amplifier A6 outputs the low-potential grayscale voltage V1L.

The voltage VB serving as the ground potential of the liquid crystal panel is input to the + input terminal of the amplifier A7, which is constructed as an inverting amplifier, the high-potential grayscale voltage V0H on the side of positive polarity is input to the − input terminal via a fixed resistor R14, and the − input terminal of amplifier A7 is connected to the output terminal via a feedback resistor R15, whereby the amplifier A7 outputs the high-potential grayscale voltage V0L.

The operation of the first embodiment will now be described with reference to FIG. 2.

According to a technique for driving a normally white liquid crystal panel, the output terminal of the amplifier Al delivers the positive-polarity fixed grayscale voltage V0H that is necessary for displaying black (which corresponds to a high potential), the output terminal of the amplifier A2 delivers the positive-polarity fixed grayscale voltage V2H that is necessary for displaying white (which corresponds to a low potential), the output terminal of the amplifier A5, which inverts and amplifies its input by a factor of one, delivers the negative-polarity fixed grayscale voltage V2L necessary for displaying white, and the output terminal of the amplifier A7, which inverts and amplifies its input by a factor of one, delivers the negative-polarity fixed grayscale voltage V0L necessary for displaying black.

Thus, the potentials applied during the white and black displays are fixed, whereby a constant contrast is obtained.

The output terminal of the amplifier A3, which is constructed as a non-inverting amplifier, delivers the positive-polarity grayscale voltage V1H necessary for displaying halftones. The grayscale voltage V1H is capable of being varied over the voltage amplification range $$VA+V2H \text{ to } VA\times(1+VR1/R7)+V2H$$

decided by the fixed resistor R7 and the variable resistor VR1. The output terminal of the amplifier A6, which inverts and amplifies its input by a factor of one, delivers the negative-polarity grayscale voltage V1L necessary for displaying halftones. The grayscale voltage V1L is capable of being varied over the same voltage amplification range as that indicated above. Thus, the grayscale voltages necessary for displaying halftones can be varied by identical amounts on the sides of positive and negative polarity with respect to the ground potential of the liquid crystal cell, as a result of which a variable grayscale characteristic (halftone contrast) is obtained.

Figure 3:
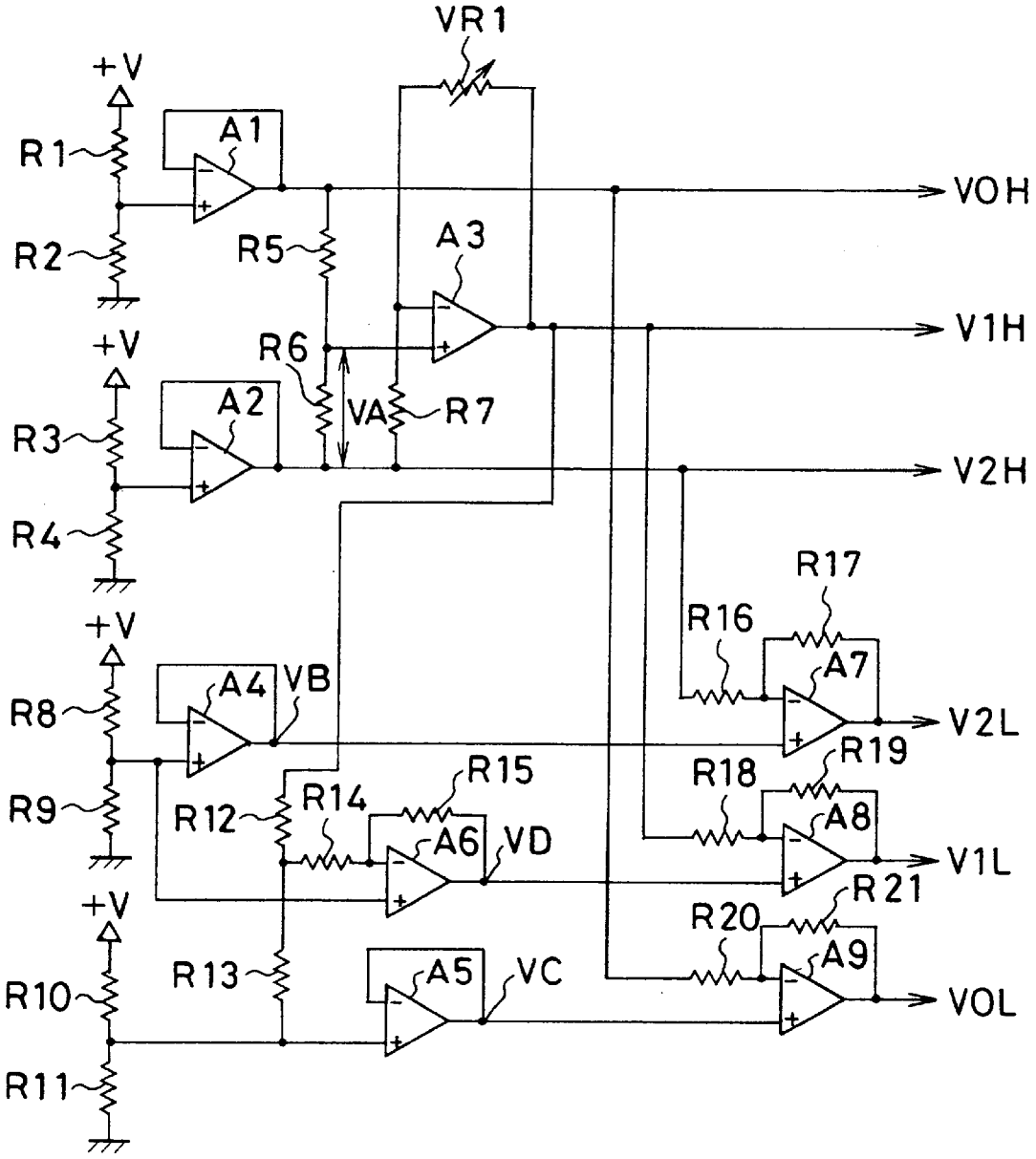
FIG. 3 is a circuit diagram illustrating the circuitry of a second embodiment of a grayscale voltage generating circuit according to the present invention.

A second embodiment of the present invention will now be described with reference to FIGS. 3 and 4, in which FIG.

Figure 4:
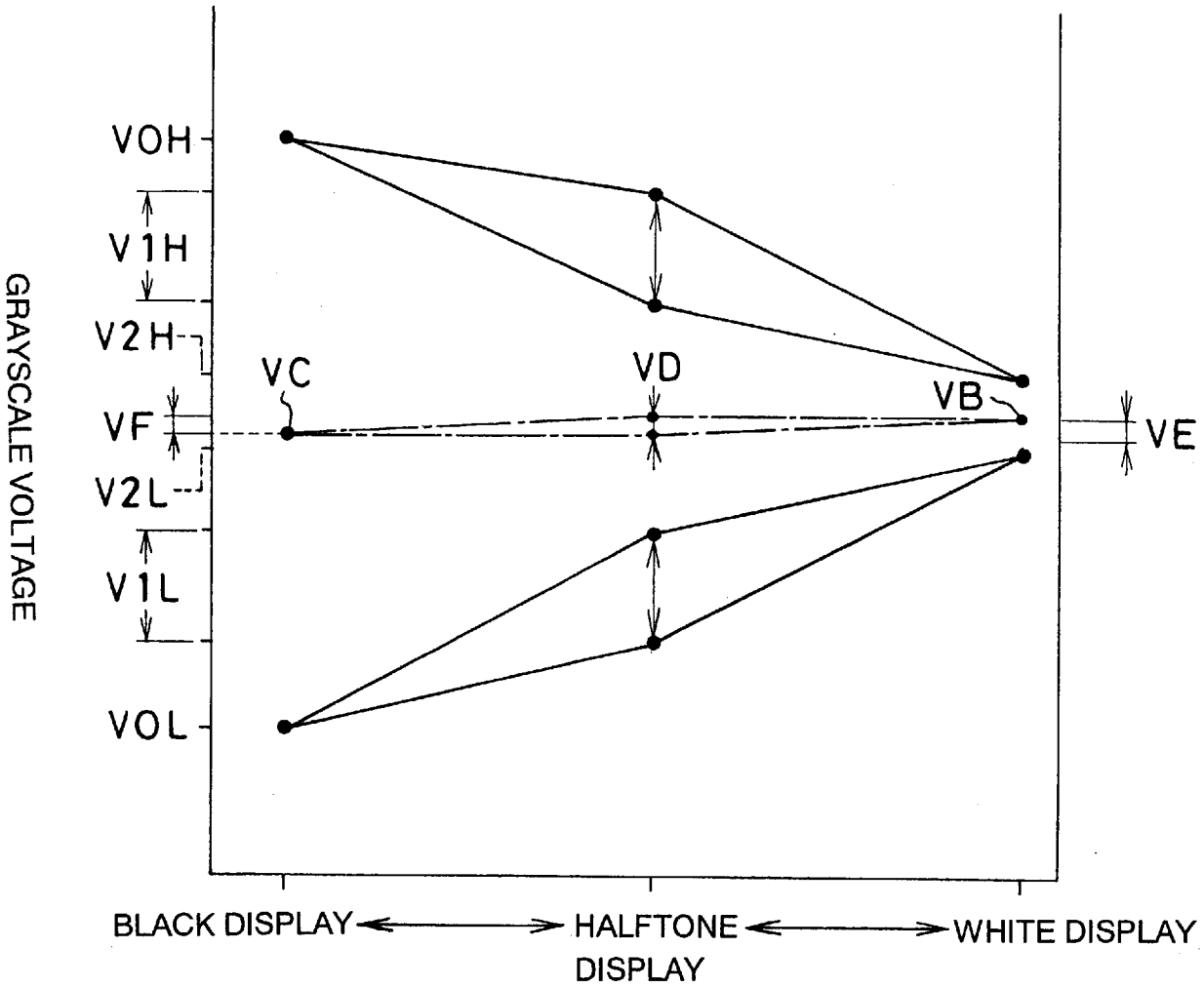
FIG. 4 is a diagram useful in describing adjustment of voltage in the second embodiment of the grayscale voltage generating circuit according to the present invention.
Figure 5:
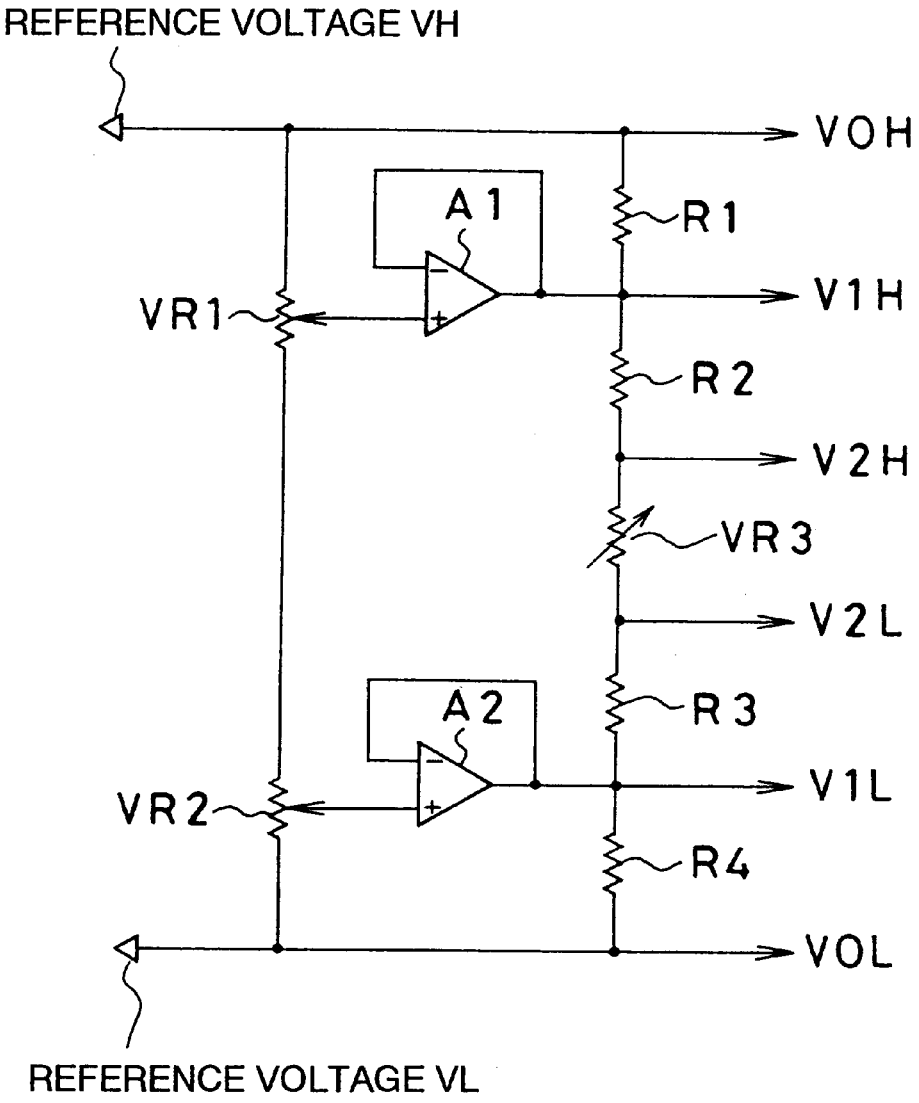
FIG. 5 PRIOR ART
FIG. 5 is a diagram illustrating the circuitry of a grayscale voltage generating circuit according to the prior art.

3 is a circuit diagram illustrating the circuitry of the grayscale voltage generating circuit and FIG. 4 is a diagram useful in describing adjustment of voltage.

The purpose of the second embodiment of the invention is to optimize feed-through correction values as well when the halftone-level grayscale voltages are varied. According to this embodiment, the section comprising the fixed resistors R8, R9 and amplifier A4 that is for generating the ground potential of the liquid crystal panel is changed as set forth below.

First, the fixed resistors R8, R9 are serially connected between the power supply voltage +V and ground, thereby potential-dividing the reference voltage. The resulting voltage is input to the + input terminal of the amplifier A4, the − input terminal and output terminal of which are connected together. As a result, the amplifier A4 produces the potential VB serving as the ground potential of the liquid crystal panel. This is a comparatively low potential. The low ground potential VB is connected to the + input terminal of the amplifier A7, which performs an inverting amplifying function.

Further, fixed resistors R10, R11 are serially connected between the reference power supply voltage +V and ground, thereby potential-dividing the reference voltage. The resulting voltage is input to the + input terminal of an amplifier A5, the − input terminal and output terminal of which are connected together. As a result, the amplifier A5 produces a comparatively high ground potential VC of the liquid crystal panel. The high ground potential VC is connected to the + input terminal of the amplifier A9, which performs an inverting amplifying function. Fixed resistors R12, R13 are serially connected between the halftone-level grayscale voltage V1H on the side of positive polarity and the voltage produced by the potential dividing operation of the fixed resistors R10, R11, thereby producing a voltage by potential division. This voltage is connected to the − input terminal of the amplifier A6, which performs an inverting amplifying function, via a resistor R14. The − input terminal of this amplifier is connected to the output terminal via a feedback resistor R15. The voltage produced by the fixed resistors R8, R9 by potential division is connected to the + input terminal of the amplifier A6. As a result, the amplifier A6 outputs a ground potential VD of the liquid crystal panel. This is a halftone-level potential. The halftone-level potential VD is connected to the + input terminal of the inverting amplifier A8.

According to the technique for driving a normally white liquid crystal panel, a feed-through value increases when the voltage applied to the liquid crystal is increased and decreases when the applied voltage is reduced. This is a characteristic of the liquid crystal. With the arrangement of the second embodiment described above, a feed-through correction value VE is produced between the liquid crystal ground potential VC (used as the reference) when black is displayed (which corresponds to high potential) and the liquid crystal ground potential VB when white is displayed (which corresponds to low potential).

In regard to the liquid crystal ground potential when a halftone is displayed, it is required that the liquid crystal ground potential VD be low when the halftone-level grayscale voltage V1H is high and that the liquid crystal ground potential VD be high when the halftone-level grayscale voltage V1H is low. First, if an amount of change in feed-through value that corresponds to a fluctuation in applied voltage when the grayscale voltage V1H is varied is generated by the voltage dividing circuit composed of the fixed resistors R12, R13 and inverting amplification by a factor of one is performed with respect to the liquid crystal ground potential VB, which is on the high-potential side, of the fixed-output ground potentials VB, VC, then the halftone-level liquid crystal ground potential VD can be produced. In a case where the liquid crystal ground potential VC for the black display (high potential) is used as the reference, a feed-through correction value VF will be produced.

Further, by varying the variable resistor VR1, which is for adjusting the grayscale characteristic, so as to vary the halftone-level grayscale voltages, the feed-through correction value VF will vary in dependence upon the varied grayscale voltages and the halftone-level grayscale voltages V1H, V1L will become grayscale voltages of the same potential with respect to the liquid crystal ground potential VD to which the feed-through correction value VF has been reflected.

Thus, in accordance with the second embodiment of the present invention, by varying the single variable resistor VR1 for adjustment of the grayscale voltage characteristic, halftone-level grayscale voltages on the sides of both positive and negative polarity can be adjusted while contrast between all white and all black is held constant, and it is possible to set feed-through correction values to optimum values automatically by varying the halftone-level grayscale voltages.

The present invention has a number of advantages.

First, the grayscale characteristic can be adjusted by adjusting a variable resistor at a single location. As a result, the end user of the liquid crystal monitor is capable of adjusting the grayscale characteristic with ease without using measuring equipment such as a voltmeter. The reason for this is that, unlike the prior art, the grayscale voltages on the sides of positive and negative polarity need not be adjusted separately over identical voltage ranges.

Second, long term image sticking of the liquid crystal monitor screen, which occurs when halftone-level grayscale voltages are varied, can be reduced. The reason for this is that when the halftone-level grayscale voltages are varied, the halftone-level feed-through correction values can be optimized automatically within the grayscale voltage generating circuit.

As many apparently widely different embodiments of the present invention can be made without departing from the spirit and scope thereof, it is to be understood that the invention is not limited to the specific embodiments thereof except as defined in the appended claims.

What is claimed is:

1. A grayscale voltage generating circuit comprising:

means for generating a halftone-level reference voltage by resistance-type potential division of a potential between positive-polarity high- and low-potential grayscale voltages that are outputs obtained by amplifying voltages produced by potential division of a reference power supply voltage;

first amplifying means for generating a variable halftone-level grayscale voltage from the halftone-level reference voltage using a variable resistor as a feedback resistor; and second amplifying means for inverting all positive-polarity grayscale voltages with respect to a liquid crystal ground potential, which has been obtained by potential division and amplification of the reference power supply voltage, amplifying the inverted grayscale voltages by the same ratio and outputting the amplified voltages as negative-polarity grayscale voltages.

2. The circuit according to claim 1, wherein ground potentials of a liquid crystal panel are generated individually for every amplifier on the side of negative polarity.

3. The circuit according to claim 2, wherein when the halftone-level grayscale voltage on the side of positive polarity is varied, a halftone-level ground potential of the liquid crystal panel varies in association thereof.

4. The circuit according to claim 3, wherein the halftone-level grayscale voltage on the side of positive polarity is amplified upon being inverted with respect to a potential obtained by potential division of a potential between the halftone-level grayscale voltage on the side of positive polarity and one ground potential of the liquid crystal panel, and the amplified voltage is adopted as a halftone grayscale voltage on the side of negative polarity.

5. A grayscale voltage generating circuit comprising:

a DC power supply for producing an output voltage;

a first potential dividing circuit for generating a first reference voltage by potential-dividing the output voltage of said DC power supply;

a first amplifying circuit for generating a first grayscale voltage by performing non-inverting amplification of the first reference voltage generated by said first potential dividing circuit;

a second potential dividing circuit for generating a second reference voltage by potential-dividing the output voltage of said DC power supply;

a second amplifying circuit for generating a second grayscale voltage by performing non-inverting amplification of the second reference voltage generated by said second potential dividing circuit;

a third potential dividing circuit for generating a third reference voltage by potential-dividing the first grayscale voltage and the second grayscale voltage;

a third amplifying circuit for generating a third grayscale voltage by performing non-inverting amplification of the third reference voltage generated by said third potential dividing circuit;

a variable resistor for varying the third grayscale voltage;

a fourth potential dividing circuit for generating a fourth reference voltage by potential-dividing the output voltage of said DC power supply;

a fourth amplifying circuit for generating a liquid crystal ground potential by performing non-inverting amplification of the fourth reference voltage generated by said fourth potential dividing circuit;

a fifth amplifying circuit for generating a fourth grayscale voltage by performing inverting amplification of the first grayscale voltage with respect to the liquid crystal ground potential;

a sixth amplifying circuit for generating a fifth grayscale voltage by performing inverting amplification of the second grayscale voltage with respect to the liquid crystal ground potential; and a seventh amplifying circuit for generating a sixth grayscale voltage by performing inverting amplification of the third grayscale voltage with respect to the liquid crystal ground potential.

6. A grayscale voltage generating circuit comprising:

a DC power supply for producing an output voltage;

a first potential dividing circuit for generating a first reference voltage by potential-dividing the output voltage of said DC power supply;

a first amplifying circuit for generating a first grayscale voltage by performing non-inverting amplification of the first reference voltage generated by said first potential dividing circuit;

a second potential dividing circuit for generating a second reference voltage by potential-dividing the output voltage of said DC power supply;

a second amplifying circuit for generating a second grayscale voltage by performing non-inverting amplification of the second reference voltage generated by said second potential dividing circuit;

a third potential dividing circuit for generating a third reference voltage by potential-dividing the first grayscale voltage and the second grayscale voltage;

a third amplifying circuit for generating a third grayscale voltage by performing non-inverting amplification of the third reference voltage generated by said third potential dividing circuit;

a variable resistor for varying the third grayscale voltage;

a fourth potential dividing circuit for generating a fourth reference voltage by potential-dividing the output voltage of said DC power supply;

a fourth amplifying circuit for generating a first liquid crystal ground potential by performing non-inverting amplification of the fourth reference voltage generated by said fourth potential dividing circuit;

a fifth potential dividing circuit for generating a fifth reference voltage by potential-dividing the output voltage of said DC power supply;

a fifth amplifying circuit for generating a second liquid crystal ground potential by performing non-inverting amplification of the fifth reference voltage generated by said fifth potential dividing circuit;

a sixth potential dividing circuit for generating a sixth reference voltage by potential-dividing the third grayscale voltage and the fifth reference voltage;

a sixth amplifying circuit for generating a third liquid crystal ground potential by performing inverting amplification of the sixth reference voltage, which is generated by said sixth potential dividing circuit, with respect to the fourth reference voltage;

a seventh amplifying circuit for generating a fourth grayscale voltage by performing inverting amplification of the first grayscale voltage with respect to the second liquid crystal ground potential;

an eighth amplifying circuit for generating a fifth grayscale voltage by performing inverting amplification of the second grayscale voltage with respect to the first liquid crystal ground potential; and a ninth amplifying circuit for generating a sixth grayscale voltage by performing inverting amplification of the third grayscale voltage with respect to the third liquid crystal ground potential.

* * * * *